US006702193B1

(12) United States Patent
Gates

(10) Patent No.: US 6,702,193 B1
(45) Date of Patent: Mar. 9, 2004

(54) WINE TASTING STRAW

(76) Inventor: David Alan Gates, 117 Robin St., Napa, CA (US) 94558

( * ) Notice: Subject to any disclaimer, the term of this patent is extended or adjusted under 35 U.S.C. 154(b) by 0 days.

(21) Appl. No.: 10/206,487

(22) Filed: Jul. 25, 2002

(51) Int. Cl.[7] ..... A47G 21/18; G03B 9/20
(52) U.S. Cl. ..... 239/33; 239/16
(58) Field of Search ..... 239/33, 24, 16; 220/254.2, 254.8, 705, 707, 708, 710, 709

(56) References Cited

U.S. PATENT DOCUMENTS 3,463,361 A * 8/1969 Cook et al. ..... 222/144.5
3,718,282 A * 2/1973 Pizzoferrato ..... 239/33
3,972,326 A * 8/1976 Brawn ..... 128/202.15
6,561,434 B2 * 5/2003 Kaplan ..... 239/33

* cited by examiner

*Primary Examiner*—Davis Hwu
(74) *Attorney, Agent, or Firm*—Risto A. Rinne, Jr.

(57) ABSTRACT

An apparatus and method for the tasting of wine includes providing a conduit with an upper end and an opposite bottom end. The bottom end is sealed and preferably solid and it includes a first opening that is disposed slightly above the bottom end. The first opening is adapted to permit the wine, absent any sedimentation, to enter into the conduit when a partial vacuum is created at the upper end. A smaller second opening is provided between the upper end and the first opening that is adapted to introduce a quantity of ambient air into the conduit when a partial vacuum is created. The quantity of ambient air that is introduced is limited by the small size of the second opening to ensure that a partial vacuum sufficient to draw the wine through the conduit is maintained. The ambient air mixes with the wine that is passing through the conduit to aerate the wine in the conduit prior to its tasting.

15 Claims, 1 Drawing Sheet

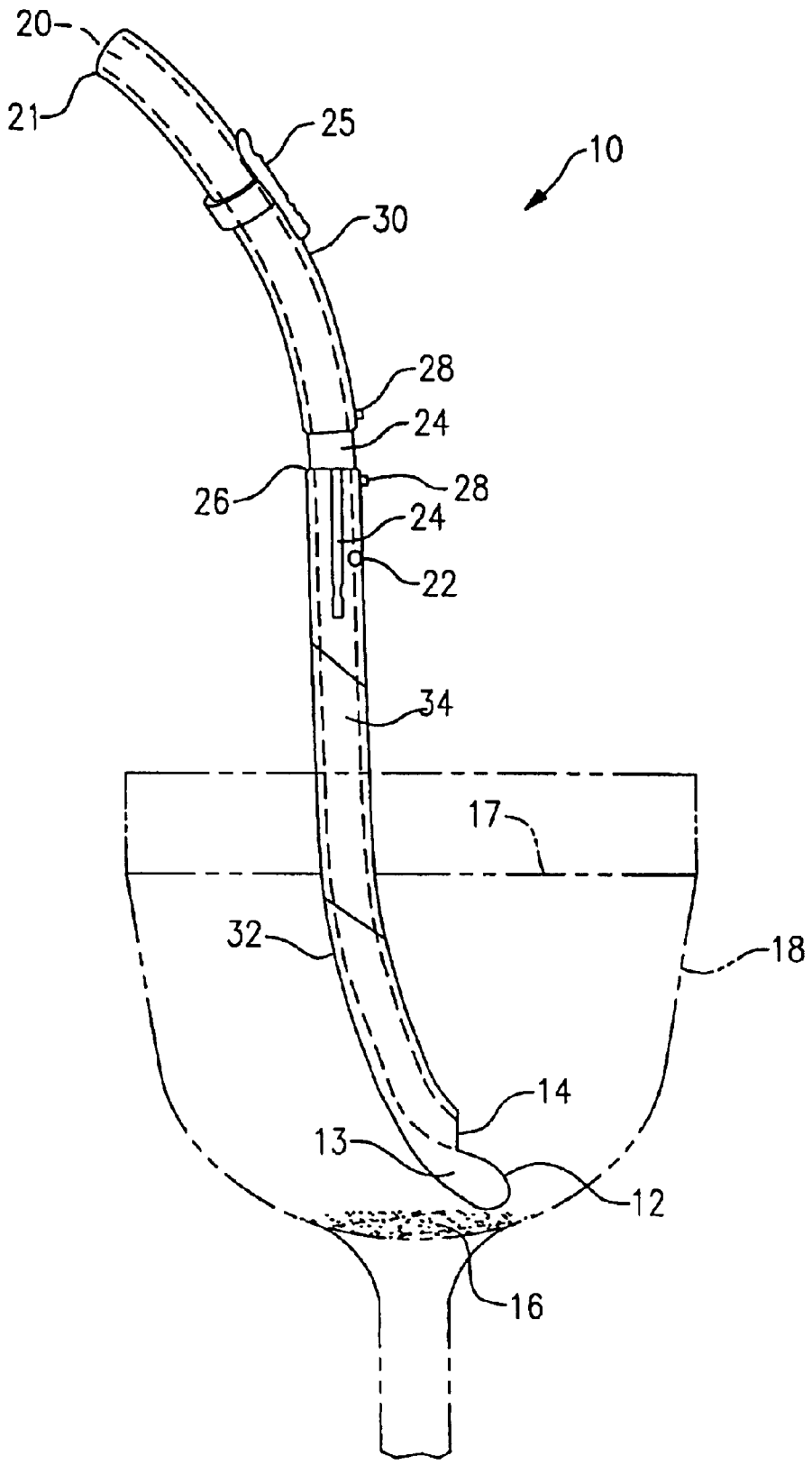
20
21
25
10
30
28
24
26
28
24
22
34
17
32
18
14
13
12
16

WINE TASTING STRAW

BACKGROUND OF THE INVENTION

1. Field of the Invention

The present invention, in general relates to wine tasting and, more particularly, to devices that facilitate the testing and comparison of wines.

The comparison of wines is an important determination to wine producers. Accordingly, wine tasters, that is people with an especially acute awareness of wine qualities, judge the attributes of many different wines. Reports in magazines, articles in various publications, and even more important, the awarding of ribbons and ranking of wines is influential in determining the sales and price of various vintage wines as well as the renown of the wine producers.

It is also important to the wine tasters themselves to be optimally able to accurately determine the subtle differences that occur between the various wines if their opinion is to be well regarded. These subtle differences include complexities and flaws that the average person is unaware of.

Currently, wine tasters use a glass to swirl the wine and sample its aroma. A sip is followed by sucking air into the mouth through pursed lips in what is commonly known as a "reverse whistle". The mixing of the wine with air is also sometimes referred to as "volatizing the esters", which is a more technical term of the process.

The reverse whistle aerates the wine and it is the infusion of air that helps to reveal the wine's various complexities and also its flaws, especially the more subtle ones.

However, after thus having sampled a few different wines, the ability to differentiate naturally diminishes. Wine tasters currently cleanse the palette by either sipping water or by consuming crackers or bread between the various samplings. The more wine that is consumed the more difficult cleansing of the palette becomes. Therefore, it is clearly desirable to limit the quantity of wine that is required to be consumed so that cleansing of the palette is easier and more effective.

While it is not generally regarded as an issue, wine does include alcohol and it is conceivable also that it is desirable to reduce the quantity of alcohol (i.e., wine) that is consumed so as to ensure that the perception of the wine taster is not substantially affected by a potential increase in the blood alcohol content level.

However, aside from the quantity that is consumed there is another problem inherent in the above approach. Before aeration can occur the wine taster first must take a sip. Then the reverse whistle procedure is used to aerate the wine, as was described hereinabove.

The problem is that the reverse whistle is no longer able to aerate a pure, undistorted and undiluted sample of the wine. This is because the wine has already mixed with the saliva in the wine taster's mouth.

The saliva affects the acidity (i.e., the pH) of the wine and accordingly, the character of the wine itself is altered before it is ever critiqued. The wine taster is discerning not the essence of the pure, original wine, but to some extent, how that particular wine reacts with the chemistry of his own saliva. This can vary from taster to taster, only increasing the subjectivity of any test result.

When the taster is looking for the most subtle of differences for a great many wine attributes, this becomes a significant obstacle. The wine is also diluted to some extent by the saliva prior to aeration and subsequent analysis. Analyzing an aerated but diluted wine sample is certainly not an optimum condition, yet this is all that the industry has had to rely upon thus far.

It is desirable to provide a device and method for tasting wines that is easy to use and inexpensive to manufacture and sell. This would permit amateur wine tasters to practice their art and improve their own ability to discern the various wines apart from each other.

Conventional straws are not used for a number of reasons, a principle one being related to sediments that accumulate at the bottom of a glass of wine. This concentration of sedimentation is to be avoided during tasting of the wine. Also, conventional straws would introduce far too much fluid for sampling.

There is a further need also and that is for aesthetics. Wine tasting is regarded much as an art form, and those who scrutinize wines regard themselves as experts in the field, artists skilled in the art of discerning subtle nuances of taste, hue, complexion, aftertaste, etc. Any device relied upon must be aesthetically appealing to the wine taster, as well as functional.

Accordingly, there exists today a need for a product and method of aerating a wine prior to tasting (i.e., sampling or critiquing) that infuses or mixes air with the wine before the wine makes contact with the saliva of the user. It is also desirable to be able to limit the quantity of wine that must be sampled.

Clearly, an apparatus that provides an aerated sample of undistorted wine would be a useful and desirable device.

2. Description of Prior Art

Wine tasting devices are not generally, known. The only known prior art device that even vaguely resembles the instant invention is known as a "bombilla" which the dictionary of the Spanish Academy defines as a "thin tube that is used to suck the mate in America, it has about twenty centimeters long and half a centimeter of diameter and the end of the tube where the liquid is introduced is almond-like full of little holes, so that the infusion passes but not the dried leaves (yerba) of the mate."

While the structural appearance of the above described device, at first appearance, may have similarities with the present invention, it differs in material respects. These differences, which will be described in more detail hereinafter, are essential for the effective use of the invention and which admit of the advantages that are not available with the prior known device.

OBJECTS AND SUMMARY OF THE INVENTION

It is an object of the present invention to provide a wine tasting straw that is inexpensive to manufacture.

It is also an important object of the invention to provide a wine tasting straw that is adapted to aerate a beverage.

Another object of the invention is to provide a wine tasting straw that is adapted to aerate a wine.

Still another object of the invention is to provide a wine tasting straw that is adapted to aerate a wine prior to the wine substantially contacting a quantity of saliva in a mouth of a user.

Still yet another object of the invention is to provide a wine tasting straw that is adapted to lessen a quantity of wine that is required for critiquing by a person skilled in the art of tasting wines.

Yet another important object of the invention is to provide a wine tasting straw that is adapted to lessen the difficulty of cleansing the palette of a person skilled in the art of tasting wines.

Still yet another important object of the invention is to provide a wine tasting straw that automatically infuses air into the fluid stream as a wine is sucked through the straw.

Still yet another important object of the invention is to provide a wine tasting straw that does not draw sediments that have accumulated at the bottom of a container into an intake fluid stream.

A still further important object of the invention is to provide a method of infusing air into a fluid stream as a fluid is being sucked through a straw.

Briefly, a wine tasting straw that is constructed in accordance with the principles of the present invention has a hollow shaft with a first opening that is elevated above the bottom of the straw and is adapted for intake of a liquid (i.e., the wine). A second and smaller opening is disposed along the length of shaft and, during use, is disposed above the liquid. When a partial vacuum is created by sucking on an upper end of the straw, both wine and air are simultaneously drawn into the straw, thereby aerating the wine prior to its entry into the mouth of a taster (i.e., a user).

BRIEF DESCRIPTION OF THE DRAWING

The drawing FIGURE is a side view of a wine tasting straw in a container of wine (container and wine in dashed lines).

DETAILED DESCRIPTION OF THE INVENTION

Referring to the FIGURE is shown, a wine tasting-straw, identified in general by the reference numeral 10. The wine tasting straw 10 can be formed of any desired material and of any preferred size. A preferred material for the wine tasting straw 10 is glass and a preferred overall length is approximately seven inches. The only restriction is that the material used must not influence or affect the taste of the fluid that is being drawn through the wine tasting straw 10.

The wine tasting straw 10 includes a solid bottom 12 at a lower end thereof. A first opening 14 is disposed a predetermined distance above the solid bottom 12, for example one-quarter of an inch above the bottom 12. The reason the first opening 14 is elevated above the bottom of the wine tasting straw 10 is to prevent any sedimentation 16 from being drawing into the wine tasting straw 10 during use.

The sedimentation 16 precipitates from certain wines 17 and settles to the bottom of a container 18 (i.e., a glass shown in dashed lines). If the sedimentation 16 were to be consumed it would greatly color the flavor and prevent an accurate tasting from occurring.

The bottom 12 is preferably smooth and rounded as well. This shape further improves aesthetic appeal. The bottom 12 includes a smooth interior 13 that is formed of a solid material (i.e., glass) that eliminates pockets and corners where the wine 17 might otherwise collect and pool, thereby distorting subsequent samples through the introduction of a residual quantity of the wine 17 from a previous tasting.

The wine tasting straw 10 includes a hollow core 20 that begins at an upper end 21 and which extends to the first opening 14. The wine tasting straw 10 acts as a conduit from the upper end 21 to the first opening 14 and is used to convey the wine 17 that enters the wine tasting straw 10 at the first opening 14, passing through the hollow core 20 and out the upper end 21 when a user (not shown) places his or her lips around the upper end 21 and draws (i.e., sucks) from the upper end 21. This action creates a partial vacuum in the wine tasting straw 10 that draws the wine 17 in through the first opening 14 and up through the wine tasting straw 10 as was described hereinabove.

The first opening 14 is sufficiently large so as to readily allow the intake of a fluid to occur therein.

Disposed along the longitudinal length of the wine tasting straw 10 intermediate the upper end 21 and the first opening 14 is a second opening 22.

The second opening 22 extends through the wall of the wine tasting straw 10 into the hollow core 20. The second opening 22 is considerably smaller in diameter than is the first opening 14 and preferably, should not exceed one-sixteenth of an inch in diameter.

In use the second opening 22 is disposed above the wine 17 and is open to ambient air.

When the user sucks on the upper end 21, the second opening 22 is too small to instantly replenish the air that is initially being drawn out of the wine tasting straw 10 (i.e., the hollow core 20). Accordingly, a partial vacuum is created and maintained sufficient to also draw the wine 17 in through the first opening 14 and up along the length of the hollow core 20.

If the second opening 22 were made too large, the wine tasting straw 10 would not operate because any partial vacuum would then be insufficient to also force, because of an insufficient difference between ambient air pressure and the pressure in the hollow core 20, the wine 17 to enter at the first opening 14 and travel upward and through the entire length of the hollow core 20.

When the wine 17 rises to the level of the second opening 22, the ambient air that is simultaneously being drawn into the hollow core 20 mixes with the wine 17 and automatically aerates it. This aeration occurs prior to the wine 17 contacting any saliva or other substances that may be present in the mouth of the user, thereby ensuring that an accurate, undistorted tasting of an aerated sample of the wine 17 can occur.

Furthermore, because the size of the second opening 22 in comparison to the first opening 14 is fixed and because this ratio determines the air/wine 17 mixture that is drawn into the wine tasting straw 10, all samples taken are uniformly aerated, thereby removing this as a potential source of variability such as would occur if the user were to draw more or less air into his mouth using instead the prior art "reverse whistle" process.

Furthermore, only a small quantity of the wine 17 need be sampled making it much easier to cleanse the palette. Accordingly, the user can more accurately critique various samples.

The wine tasting straw 10 itself does not pool the wine 17 and may readily be used to sample another type of wine (not shown). If desired, it can be rinsed out, shaken, or cleaned in any preferred way.

Enhancements made to the wine tasting straw 10 include a clip 24, similar to a type of clip (not shown) that is used to secure a pen to a shirt pocket (not shown). Similarly, the wine tasting straw 10 may be secured to a shirt pocket by use of the clip 24.

The clip 24, as shown, is plain in appearance. Ornamentation 25 can be added separately to the wine tasting straw 10 or it can be included within the design of additional modified types of clips (not shown). The ornamentation 25 preferably includes a grape cluster and it is also preferable to provide an enlarged area on an upper portion of the ornamentation 25 that resemble a grape leaf and which can be used as a finger rest during use.

The clip 24 is preferably secured along the longitudinal length of the wine tasting straw 10. A recess 26 is provided into which a band portion of the clip 24 contracts and fits. Alternately, a pair of raised protrusions 28 can be used to secure the clip 24 along the longitudinal length of the wine tasting straw 10. How the clip 24 is secured is a matter of design choice.

The preferred shape for the wine tasting straw 10 includes at least one upper curved portion 30 and preferable also a lower curved portion 32 so as to resemble an "S" in shape. This is more aesthetically appealing than a purely linear configuration, although a linear configuration (not shown) would certainly function well.

To further improve aesthetics, the wine tasting straw 10 may include a plating 34, for example a gold plating, over any desired portion.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A wine tasting straw, comprising:

(a) a conduit that includes an opening at each end thereof; and (b) an opening through a wall of said conduit that is disposed intermediate said each end of said conduit, wherein said opening through a wall includes a cross-sectional area that is smaller than a cross-sectional area of said opening at each end thereof and wherein when a first end of said conduit is disposed in a fluid sufficient so that a lower one of said openings at each end is disposed in said fluid, said opening through a wall of said conduit is not disposed in said fluid.

2. A wine tasting straw, comprising:

(a) a shaft that includes an upper end and an opposite bottom end, wherein said bottom end is sealed, and wherein said shaft includes a hollow core that begins at a first opening and wherein said first opening is disposed a predetermined distance above said bottom end, and wherein said hollow core extends along a longitudinal length of said shaft to said upper end; and (b) a second opening that is disposed between said first opening and said upper end, wherein said second opening includes an area that is smaller than the area of said first opening.

3. The wine tasting straw of claim 2 wherein said wine tasting straw is formed of a glass.

4. The wine tasting straw of claim 2 wherein said shaft includes a curved portion.

5. The wine tasting straw of claim 4 wherein said shaft includes a second curved portion.

6. The wine tasting straw of claim 5 wherein said shaft includes an S shape thereto.

7. The wine tasting straw of claim 2 wherein said second opening includes a diameter that does not exceed one-sixteenth of an inch.

8. The wine tasting straw of claim 2 wherein said bottom end is solid.

9. The wine tasting straw of claim 2 wherein said first opening is adapted for placement into a fluid and wherein said second opening is not adapted for placement into said fluid when said first opening is disposed in said fluid.

10. The wine tasting straw of claim 9 wherein said fluid includes a wine.

11. The wine tasting straw of claim 9 wherein said wine tasting straw is adapted for use in transporting said fluid into said first opening, through said hollow core, and out of said upper end when a partial vacuum is created at said upper end.

12. The wine tasting straw of claim 11 wherein said second opening is adapted to permit a quantity of ambient air to enter into said hollow core at said second opening and mix with a quantity of said fluid in said hollow core sufficient to produce a quantity of aerated fluid.

13. The wine tasting straw of claim 2 including a clip that is secured to said shaft, wherein said clip is adapted to secure said wine tasting straw to an object.

14. The wine tasting straw of claim 2 including an ornamental design that is attached to said shaft.

15. The wine tasting straw of claim 2 including a plating that is applied to said shaft.

* * * * *

UNITED STATES PATENT AND TRADEMARK OFFICE

CERTIFICATE OF CORRECTION

PATENT NO. : 6,702,193 B1
DATED : March 9, 2004
INVENTOR(S) : David Alan Gates

It is certified that error appears in the above-identified patent and that said Letters Patent is hereby corrected as shown below:

Title page,
Item [75], Inventors, please add the following inventors:
-- Dominic Michael Gates
Christina Kennedy Gates --

Signed and Sealed this

Sixth Day of July, 2004

JON W. DUDAS
*Acting Director of the United States Patent and Trademark Office*